United States Patent [19]

Stockdale

[11] 4,164,736

[45] Aug. 14, 1979

[54] APPARATUS FOR DISABLING AN ALARM AFTER A PREDETERMINED OPERATING PERIOD

[75] Inventor: Roy Stockdale, Huntington, N.Y.

[73] Assignee: NAPCO Security Systems, Inc., Copiague, N.Y.

[21] Appl. No.: 889,254

[22] Filed: Mar. 23, 1978

[51] Int. Cl.[2] ..... G08B 19/00

[52] U.S. Cl. ..... 340/530; 340/521; 340/541

[58] Field of Search ..... 340/500, 506, 517, 521, 340/527, 529, 530, 541

[56] References Cited

U.S. PATENT DOCUMENTS 3,979,740 9/1976 Forbat et al. ..... 340/529

*Primary Examiner*—Alvin H. Waring

*Attorney, Agent, or Firm*—Arthur L. Plevy

[57] ABSTRACT

Apparatus for disabling an alarm after a predetermined operating period employs a relay which is operated by a gate circuit. A contact of the relay applies operating potential to an alarm. An oscillator energizes a counter circuit and after a predetermined selectable period, the counter circuit inactivates the relay via the gate to cease alarm operation.

10 Claims, 1 Drawing Figure

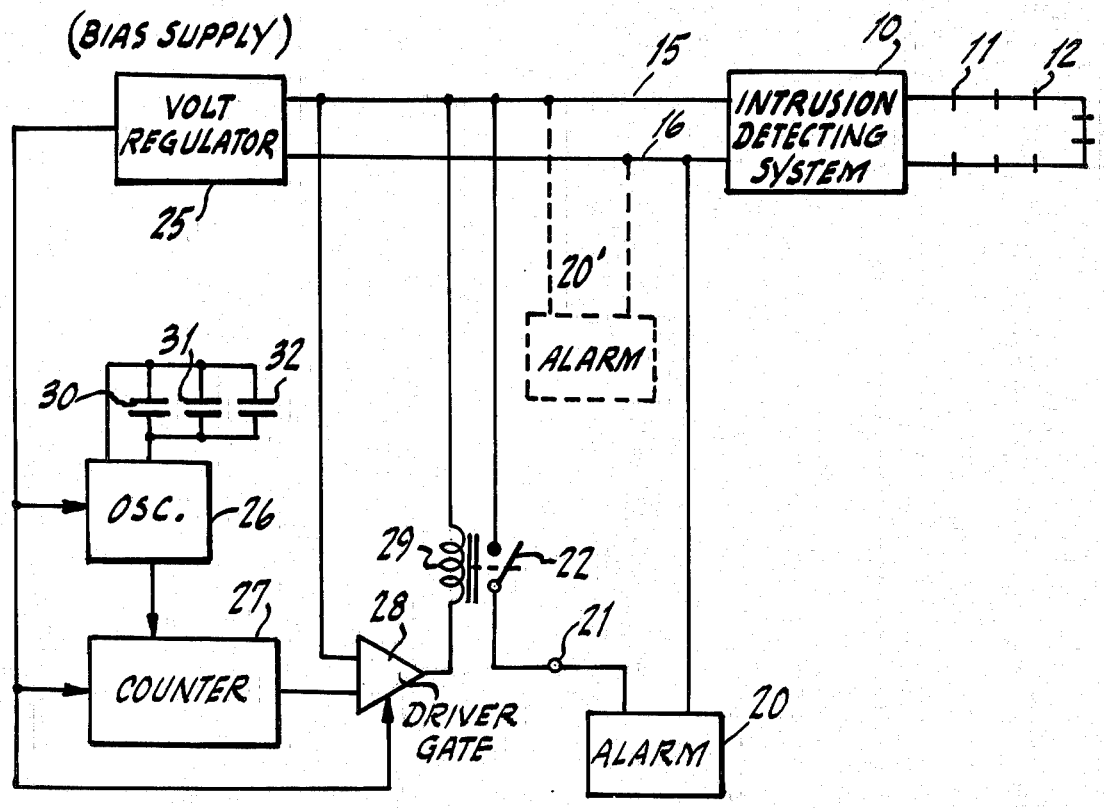
(BIAS SUPPLY)
VOLT REGULATOR
25
15
16
10
INTRUSION DETECTING SYSTEM
11
12
20'
ALARM
31
32
30
OSC.
26
29
22
27
28
21
COUNTER
DRIVER GATE
ALARM
20

APPARATUS FOR DISABLING AN ALARM AFTER A PREDETERMINED OPERATING PERIOD

BACKGROUND OF INVENTION

This invention relates to intrusion systems such as burglary and fire protection systems and more particularly to apparatus for disabling an alarm after a predetermined period of operation.

As is well known, there exists many systems which serve to protect both commercial and residental property. These systems are commonly referred to as intrusion detection systems and may monitor premises for fire or burglary or both. Essentially, many systems incorporate an alarm such as a bell or a siren which notifies persons in the vicinity of such an intrusion to enable them to contact the Fire or Police Department. As one can ascertain, a great number of systems have been recently incorporated on both residential and commercial properties to afford such protection.

In any event, it is well known that if the system operates or a false alarm is produced, the bell or siren will continue to sound its alarm until the system is disabled. In the case of residental property, the owners may be away and hence, such alarms have been known to sound for prolonged periods creating great disturbances and inconvenience to the neighborhood. Hence, many townships and municipalities have placed local ordinances in attempting to control the period during which such an alarm may operate. As one can ascertain, this period if it is long enough, should suffice to give the adequate notice without the alarm continuing operation.

Basically, many of the prior art systems do not incorporate an alarm cutoff period and hence, once the alarm is activated by an intrusion, it will continue to operate contrary to the above considerations.

It is therefore an object of the present invention to provide apparatus for disabling an alarm after a predetermined operating period. The apparatus is adapted to be used with most existing and conventional intrusion systems and can be easily and economically added, as will be explained.

BRIEF DESCRIPTION OF PREFERRED EMBODIMENT

Apparatus for disabling an alarm after a predetermined operating period, comprising an intrusion detection system operative to provide an output potential at a terminal upon detection of an intrusion, an oscillator responsive to said output potential for providing at an output, a series of pulses at a selectable frequency rate, a counter responsive to said output potential and operative to receive said pulses to provide an output signal for a predetermined number of pulses from said oscillator, said output signal manifesting said predetermined operating period, alarm indicating means having at least one input terminal for receiving a potential to cause said alarm to operate, and switching means coupled to said alarm means and having a first mode responsive to the presence of said output potential for operating said alarm and having a second mode responsive to said output signal from said counter to disable said alarm after said predetermined number of pulses from said oscillator.

BRIEF DESCRIPTION OF THE FIGURE

The sole FIGURE is a block diagram of apparatus for disabling an alarm according to this invention.

DETAILED DESCRIPTION OF DRAWINGS

Referring to the FIG, there is shown an intrusion detection system 10. As indicated, the system 10 is a conventional burglar or fire alarm system; which system is presently available.

Essentially, the system 10 operates to monitor conditions on premises and will activate an alarm during a fire or a burglarly or both.

Shown coupled to the system 10 is a closed loop of sensing devices such as 11 and 12. In one type of system, if any device opens or is activated, the intrusion detection system will operate to place a potential on the output leads 15 and 16 which serve to operate an alarm 20. The alarm 20 is shown in dashed line configuration to indicate its presence and position in a conventional system. The alarm 20 may be a bell or a siren or some other audible type alarm which functions to produce a warning to those in the vicinity that an intrusion of the premises being monitored has occurred.

In the present invention, as will be explained, the alarm 20 is wired to terminals 15 and 16 via a controlled relay contact 22. The relay contact 22 is controlled by means of a timing circuit so that it will disable the alarm 20 after a predetermined and selected operating time. The time of operation would be selected according to the particular requirements of the community or according to the particular preference of the user.

In accordance with this invention, the leads 15 and 16 are directed to a voltage regulator 25. The voltage regulator 25 is a conventional circuit and essentially, functions to receive the voltage impressed across leads 15 and 16 and to provide a regulated voltage perhaps of a different magnitude at the output. The output of the voltage regulator is applied to an oscillator circuit 26, a counter circuit 27, and a relay driver circuit 28. The above described components may be integrated circuit modules and as will be explained, are commercially available.

It is also understood that while the above described description shows an electromechanical relay 29, a suitable semiconductor can be substituted in operation as would be precisely known to those skilled in the art.

The oscillator 26 is an RC oscillator. Many examples of RC oscillators are well known in the art and as such, the oscillator 26 may be an astable or free-running multivibrator. In such curcuits, the frequency of operation is a function of capacitance controlling the time of the circuit. In this manner, shown coupled to the oscillator 26 is a bank of parallel capacitors 30, 31 and 32. Thus, by removing a capacitor as 30–32, one can change the time of operation of the oscillator 26.

The output of oscillator 26 is applied to a multi-stage counter circuit 27. The counter circuit 27 comprises a chain of cascaded binary multivibrators and hence, produces an output after receiving at an input, a predetermined number of pulses from oscillator 26. Examples of counting circuits are well known in the state of the art and the advantage of a counter as above described, is that it is relatively independent of the input frequency and can operate to count or divide over a wide frequency range of input pulses.

The output of the counter 27 is applied to an input of a gate and relay driver circuit 28. Another input to gate 28 comes directly from lead 15 associated with the intrusion detection system. The output of the gate 28 is coupled through a relay coil 29 back to lead 15 which serves as a source of operating potential. The relay coil 29 serves to activate the contact 22, as will be explained.

OPERATION OF THE CIRCUIT

The above described circuit operates as follows:

Assume that an intrusion has taken place and therefore the intrusion detection system 10 serves to place an operating potential between leads 15 and 16. The presence of a potential on line 15 immediately energizes the gate 28. The relay coil 29 also coupled to lead 15 is thus activated. Activation of the relay coil immediately closes contact 22 and the alarm 20 receives operating potential via lead 15 and immediately begins to operate, thus sounding its warning and as completely afforded by the prior art systems. The potential impressed across lines 15 and 16 also supplies operating potential to oscillator 26 and counter 27. The oscillator thus begins to operate and the counter 27 receives the output pulses from the oscillator and commences a counting operation. A binary counter, for example such as 27, may be formed to provide a division according to a binary number such as 8,16,32,64,128 and so on. After a predetermined number of pulses are received by counter 27, the output is decoded according to the above described division ratio. The decoded output from the counter is applied to gate 28 to disable the gate. Hence, after the above described predetermined period, the relay 29 is deactivated and contact 22 opens. This therefore removes the operating potential from the alarm 20 and hence, the alarm 20 ceases to provide its output signal.

As above indicated, the above described circuit can be used with any existing intrusion system which employs an audible alarm as 20 or an alarm operated via output leads as 15 and 16. The above described circuit makes it extremely simple to change the operating time as desired. To accomplish this, one merely removes or adds a suitable capacitor as 30 to 32. The counter 27 is selected to provide a division ratio as indicated above, which can be a relatively large ratio. Hence, the frequency stability of the oscillator is absolutely noncritical in the development and generation of a relatively long time period; which period is selected to assure that proper notice and warning is given. Hence, typical periods for operating an alarm which can be accommodated by the above described circuitry may be between five to thirty minutes and again depending upon local or individual requirements.

By controlling the frequency of the oscillator 26 according to a period of time, one need not in any manner vary the length of the counter 27 or its division ratio. This therefore enables the use of typical available and inexpensive circuitry such as the type found in calculators, digital watches and so on.

The above described system, as indicated, enables disabling an alarm after a predetermined operating period and is completely compatible for use with most conventional intrusion systems not incorporating such a feature.

I claim:

1. Apparatus for disabling an alarm after a predetermined operating period, comprising:

(a) an intrusion detection system operative to provide an output potential at a terminal upon detection of an intrusion, (b) an oscillator responsive to said output potential for providing at an output, a series of pulses at a selectable frequency rate, (c) a counter reponsive to said output potential and operative to receive said pulses to provide an output signal for a predetermined number of pulses from said oscillator, said output signal manifesting said predetermined operating period, (d) alarm indicating means having at least one input terminal for receiving a potential to cause said alarm to operate, (e) switching means coupled to said alarm means and having a first mode responsive to the presence of said output potential for operating said alarm and having a second mode responsive to said output signal from said counter to disable said alarm after said predetermined number of pulses from said oscillator.

2. The apparatus according to claim 1 wherein said oscillator comprises an RC oscillator capable of providing any one of a selectable number of frequency rates according to the addition of a capacitor to said oscillator.

3. The apparatus according to claim 1 wherein said counter is a binary counter comprising a predetermined number of cascaded multivibrators.

4. The apparatus according to claim 1 wherein said alarm indicating means is an audible alarm.

5. The apparatus according to claim 1 wherein said switching means includes a relay, having an operating coil and a contact switchable from a first opened position to a second closed position when said relay coil is energized, said contact coupled between said input terminal of said alarm means and said output potential terminal of said intrusion detection system to cause said alarm to operate when said coil is energized and means coupled to said coil for energizing said coil in a first mode and for deenergizing said coil in response to said counter providng said output signal in a second mode.

6. The apparatus according to claim 5 wherein said means for energizing said coil includes a gate circuit having an output coupled to said coil and a first input terminal coupled to said output terminal of said intrusion detection system to operate said coil in a first mode, and a second input terminal coupled to said counter for inactivating said coil in a second mode during the presence of said output signal.

7. The apparatus according to claim 1 further including a voltage regulator having an input terminal coupled to said output potential terminal of said intrusion detection system to provide at an output terminal, a regulated voltage for energizing said oscillator, counter and switching means.

8. The apparatus according to claim 1 wherein said intrusion detection system is a fire detection system.

9. The apparatus according to claim 1 wherein said intrusion detection system is a burglar detection system.

10. The apparatus according to claim 1 wherein said predetermined operating period is between five to thirty minutes.

* * * * *